United States Patent [19]

Banker, Jr.

[11] 4,376,491

[45] Mar. 15, 1983

[54] FLEXIBLE MEMBRANE CONTAINER CLOSURE

[75] Inventor: Harold Banker, Jr., Turnersville, N.J.

[73] Assignee: NER Data Products, Inc., Glassboro, N.J.

[21] Appl. No.: 314,571

[22] Filed: Oct. 26, 1981

[51] Int. Cl.[3] ..... B65D 7/28; B65D 6/40; B65D 39/00

[52] U.S. Cl. ..... 220/200; 220/262; 150/3

[58] Field of Search ..... 220/200, 262; 150/3, 150/7, 15, 42, 44, 0.5; 222/507

[56] References Cited

U.S. PATENT DOCUMENTS

| | | | |
|---|---|---|---|
| 1,431,918 | 10/1922 | Arthur | 150/3 |
| 2,405,682 | 8/1946 | Bogoslowsky | 220/262 |
| 2,695,608 | 11/1954 | Gillon | 220/200 |
| 2,718,225 | 9/1955 | Wallin | 220/200 X |
| 2,785,795 | 3/1957 | Ryno et al. | 206/583 X |

*Primary Examiner*—George T. Hall
*Attorney, Agent, or Firm*—Fred L. Denson

[57] ABSTRACT

A container closure comprising a cylindrically shaped, resilient, distortable membrane having a first terminal end fully affixed to the periphery of a first closure body providing a discharge aperture of predetermined size and a second terminal end fully affixed to a second coacting closure body coaxially disposed about the outside periphery of the first closure body and adapted for relative bi-directional rotation with respect to the first closure body. Relative counterrotational movement of the membrane terminal ends in one direction causes closure and sealing of the annular throat inherently created and disposed within the membrane while relative counterrotational movement in a second direction causes the previously closed annular throat to open.

8 Claims, 12 Drawing Figures

FLEXIBLE MEMBRANE CONTAINER CLOSURE

BACKGROUND OF THE INVENTION

1. Field of the Invention

The present invention relates to apparatus for closing and sealing containers or compartments therein. More specifically, the invention relates to resealable closure apparatus that provides a plurality of discharge apertures and does not require removal in any fashion from the container upon which it is affixed.

2. Description of the Prior Art

Container closures are known in the art that provide a plurality of discharge apertures within one given container. One such closure device provides two plates disposed parallel to each other and fastened together at a point central upon the surface of the plates such that (1) the plates may be rotated axially with respect to each other about the fastening point, and (2) the interfacing surfaces of the plates intimately contact each other fully across their surfaces or at least partially across their surfaces. The plate innermost to the container is usually affixed to the container body and provides an aperture equal to or greater than the size of the largest of any number of apertures provided on the outermost plate. One disadvantage of this closure device is that in order to be fully recloseable, the largest aperture cannot exceed half of the available discharge area dimensions of the container unless the two plates themselves extend beyond the dimensions of the container discharge area. The first alternative is undesirable in applications where the container contents have poor flow properties. In the second alternative, the container is awkward to store, package and handle and is unusable in instances where the container must be inserted into a female receiving member or receptacle having a confined space about the container.

Another closure device employs a flat plate affixed to a container having a channel or flanged segments into which a second plate is slidably engaged with action parallel to the surface of the first plate. The first plate provides an aperture of any size relative to the container discharge area, the largest aperture, however, must be smaller than the dimensions of the second plate. The second plate may be positioned to fully conceal the aperture of the first plate. The disadvantage of this closure device, like that of the first described device, is that the aperture cannot be greater than half the available discharge area unless the closure device itself extends beyond the discharge area dimensions of the container.

Yet another closure device employs a tubular nozzle permanently affixed to a container and an array of adapter nozzles, each having a different aperture size smaller than the fixed nozzle aperture and either nested one upon the other and about the fixed nozzle or hingeably attached about the outside of the fixed nozzle. By partially or completely removing one adapter nozzle from the fixed nozzle and replacing it with another, a variety of restrictive discharge apertures can be provided. One disadvantage of this closure device is that aperture selection is restricted to the number of adapter nozzles provided. Another disadvantage is that aperture selection can seldom be accomplished in other than an upright position. Still another disadvantage is that the nozzle replacing function does not allow aperture selection which is truly integrally functional with the container or sufficiently convenient for many applications.

Other closure devices are known in the art which render a container resealable while avoiding complete separation of the closure device from the container. One such device has a threaded cap which engages threads on the outside surface or inside surface of the container throat and a flexible strip or hinge having one end affixed to the container and the other end affixed to the closure device. Another closure device commonly known as a snap-cap, has an inwardly extending flange which engages below an outwardly extending flange on the rim of the container throat. The cap, which is connected by a flexible strap or hinge to the container, is sufficiently flexible to permit the flanges to distort and slip around each other when a prying force is applied upwards at the periphery of the cap. One disadvantage of these closure devices is that they generally cannot be operated while the container is in a dischargeable position or while the container is engaged within a receiving body. Another disadvantage is that these closure devices cannot be rendered fully conformable to any given geometric container shape or configuration which may be required to be adjacent the closure device.

Yet another closure device which is resealable and remains integral with the container comprises a resilient member which may be pierced or sufficiently distended to separate the member by stretching a cell or collapsed channel with an external object such as a needle. The resiliency of the closure member enables it to reseal after removal of the external object by means of compression about the puncture or recollapse of the channel.

Still another resealable closure device provides a nozzle pivotably mounted and at least partially concealed within a second closure member affixed to the container. The nozzle contains a passage extending from the discharge region of the nozzle to the portion of the nozzle which is concealed within the second member. When the nozzle is positioned at an extreme endpoint of movement, the passage in the nozzle is blocked by a solid portion of the second member. When the nozzle is pivoted to any position beyond the extreme endpoints, the nozzle passage is exposed to a portion or the entirety of an aperture disposed within the second member which allows passage of the container contents through the second member and into the nozzle passage. One disadvantage of the two above mentioned closure devices is that they are operable only with very free flowing contents or with contents which require an internally exerted container pressure to force discharge. Another disadvantage is that these closure devices may not have the sealing ability to prevent the contents from escaping the container or outside contaminents from entering over a period of storage or under handling conditions without resorting to the addition of extra sealing components.

SUMMARY OF THE INVENTION

The present invention provides an improved resealable closure apparatus which (1) is useable with a wide variety of contents, be they gases, liquids or solids having a wide variety of properties, (2) opens to an infinite number of discharge aperture sizes, and (3) is conveniently adaptable to any container configuration. This is achieved in accordance with the present invention by container closure apparatus comprising a first closure body providing a discharge aperture of predetermined size, a second coacting closure body coaxially disposed about the outside periphery of the first closure body and adapted for bi-directional rotation with respect to the first closure body and a cylindrically shaped resilient, distortable membrane having a first terminal end fully affixed to the periphery of the first closure body and a second terminal end fully affixed to the periphery of the second closure body. Relative counterrotational movement of the membrane ends in one direction provides an infinite number and size of annular discharge apertures. Changing the direction of counterrotational movement provides closure and sealing of the discharge aperture.

The closure apparatus of the present invention provides a number of advantages. The closure apparatus allows the container contents to be fully or partially discharged and the container subsequently reclosed and resealed while the container is presented in any upright or inverted discharge position or while the container is engageably coupled to or coacting with any receptacle. The closure apparatus is readily adaptable to become fully conformed to any container configuration and can be designed to be integral with the container or to function separately and be subsequently affixed to the container by a variety of means well known in the art. The sealing integrity of the closure apparatus may be increased by further conterrotational movement beyond the point where sealing of the closure membrane is first achieved. Such continued counterrotational movement increases the surface area of the membrane that comes into compressible contact.

The invention and its features and advantages will become more apparent by referring to the accompanying drawings and to the ensuing detailed description of illustrative preferred embodiments.

DETAILED DESCRIPTION OF THE PREFERRED EMBODIMENTS

Because containers and container closures are well known, the present description will be directed in particular to elements forming part of, or cooperating more directly with, apparatus in accordance with the present invention. It is to be understood that container and closure elements not specifically shown or described may take various forms well known to those having skill in the art.

Figure 1:
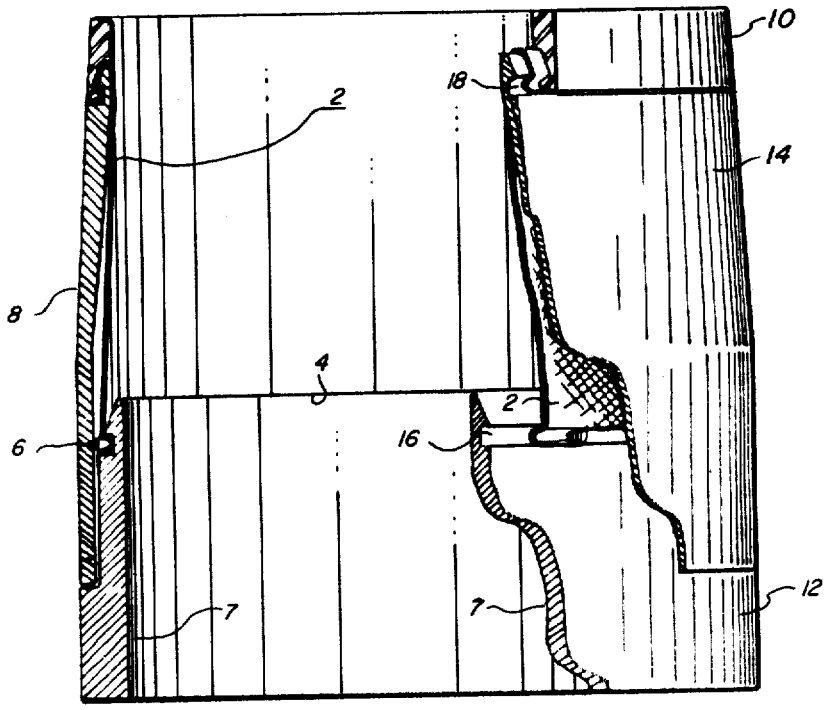
FIG. 1 is a sectional view of one embodiment of a container closure apparatus according to the invention and showing the closure membrane displaced in a fully open position.
Figure 2:
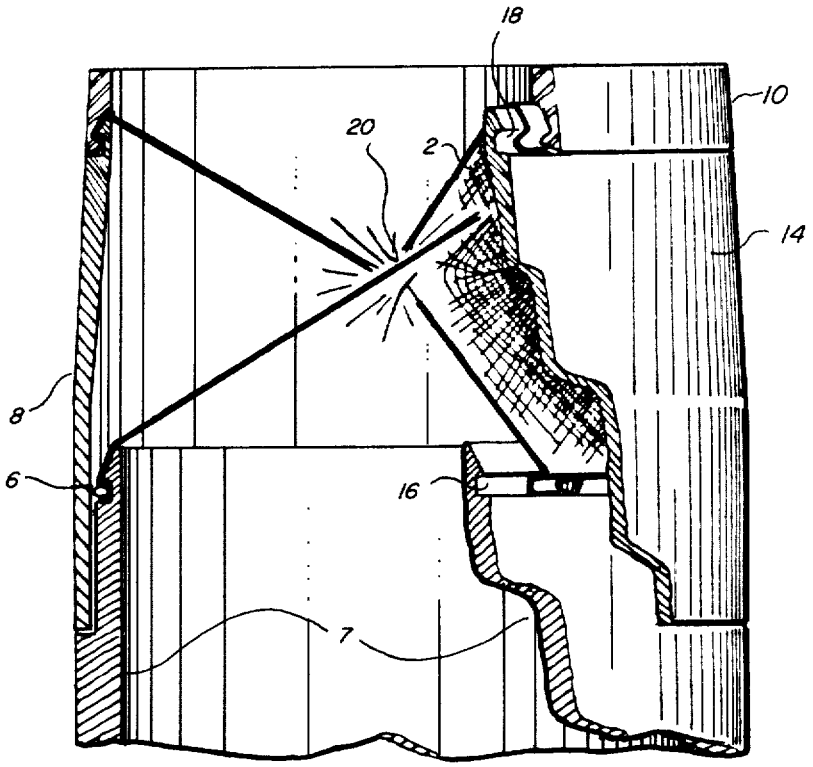
FIG. 2 is a sectional view of the container closure apparatus of FIG. 1 showing the closure membrane in a fully closed position.

Referring now to the drawings and in particular to FIGS. 1 and 2, a preferred embodiment of container closure apparatus according to the invention is shown having a membrane 2 which is fully affixed along one terminal end to the periphery of a container opening 4 and compressibly attached thereto by a clamping device 6. The opposite terminal end of the membrane 2 is fully affixed to the periphery of a cylindrical body 8 which is disposed peripherally about the outside of the container 7. Membrane 2 is compressibly attached to the body 8 by a second clamping device 10.

Membrane 2 may be comprised of any suitable material providing sufficient flexability to achieve the desired distortion action when coacting with the container 7 and body 8 in the manner described in detail hereinbelow. The optimum membrane material will depend upon the particular material to be contained and the various applications of the container. Useful membrane materials include continuous films or woven structures of polyethylene, ethylene vinyl acetate, polypropylene, cellulose acetate, cellulose propionate, nylon and various compounds thereof. Such membrane materials may or may not include oriented or non-oriented fillers.

Preferably, the membrane materials are elastomers including polyisoprene, styrene butadiene, isobutylene isoprene, ethylene propylene, butadiene acrylonitrile, epichlorohydrin, polysulfide, polychloroprene, chlorosulfonated/polyethylene, polyester/polyether urethane, polysiloxane, fluorosilicone, and fluorinated hydrocarbon or polyolefin compositions.

The membrane 2 is dimensionally designed with respect to its coacting members 7 and 8 such that it is cylindrical in shape and of a diameter that is most efficient in providing fully non-restrictive access to the container 7 when the membrane diameter most closely approximates the inside diameter of the body 8. It has also been learned that a relationship exists between the composition and diameter of the membrane and the longitudinal dimension of the membrane. For a given membrane composition and thickness, the operating efficiency of the closure apparatus is increased in increasing proportion to an increase in the longitudinal dimension of the membrane with respect to its diameter. It has also been learned that an increase in elasticity of the membrane is inversely proportional to the required longitudinal dimension. Furthermore while any membrane thickness may be employed, a thickness between 0.009 inches and 0.065 inches has been found suitable for the majority of applications.

The container 7 and body 8 may be formed of any suitable material so long as they are sufficiently rigid in the regions at which the membrane is affixed so as to provide the desired access passage to the container. Suitable materials include plastics, metals, and various kinds of glass.

The clamping devices 6 and 10 may be made of any material sufficiently flexible to fit about the membrane 2, the container 7 and body 8 such that the device compressably attaches the membrane 2 to the container 7 and the body 8. The clamping devices are preferably in the form of a continuous ring. Suitable clamping device materials include various plastic and elastomer materials. The clamping devices are fitted about the outside of membrane 2 which in turn is fitted about the outside diameters of the annular regions 12 and 14 of the container 7 and body 8 at their respective terminal ends. The container 7 and body 8 each has an area 16 and 18, respectively, immediately adjacent the aforementioned outside annular region where their respective outside diameters are made smaller by means of a groove. To attach the membrane, the membrane and clamping devices are forced about and beyond the outside annular regions 12 and 14 and then into the grooves 16 and 18.

While the greatest clamping integrity is achieved with the aforementioned clamping devices, it is possible for some applications to affix the membrane 2 to the container 7 and body 8 by other means such as adhesive or by sonic or thermal welding.

In FIG. 1 the membrane 2 is shown in its fully open position at which the membrane 2 has its elastic properties in the most relaxed state. When the container 7 and body 8 are rotably displaced relative to each other in opposite directions, the membrane 2 distorts and provides an increasing smaller annular opening 20 according to the degree of rotation of the container 7 and body 8 until complete closure of the membrane opening is achieved as shown in FIG. 2. When a fully closed position is achieved, the membrane's inside surfaces converge at a point central to the access opening 20 and come into compressible surface contact so as to provide an absolute seal between the area within and the area outside of the closure apparatus.

Figure 3:
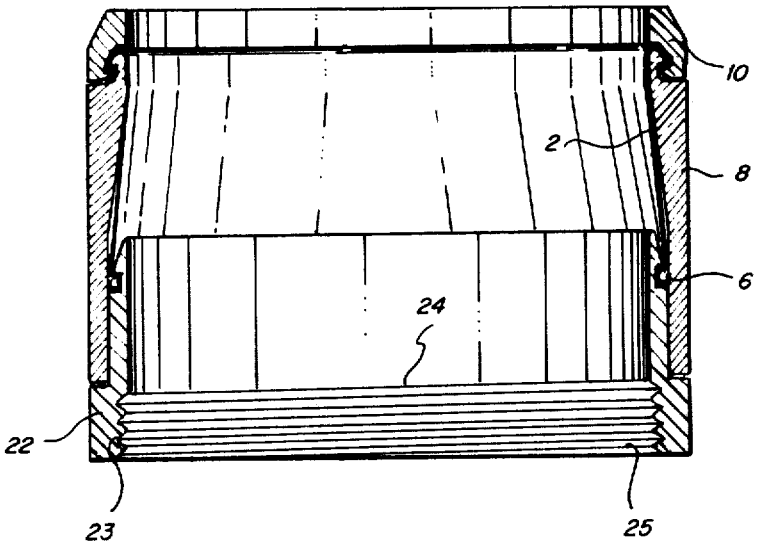
FIG. 3 is a sectional view of another embodiment of a container closure apparatus according to the invention having threaded means disposed about the container openings for attachment to the container.

The embodiment shown in FIG. 3 is identical to the embodiment shown in FIGS. 1 and 2 except that the container 7 is replaced with a body 22 having threads 23 for engagement to a conventional container 24 having compatable threads 25, thereby permitting use of a closure apparatus according to the present invention and realizing its benefits without requiring a container to be specifically preformed to coact with the closure device.

Figure 4:
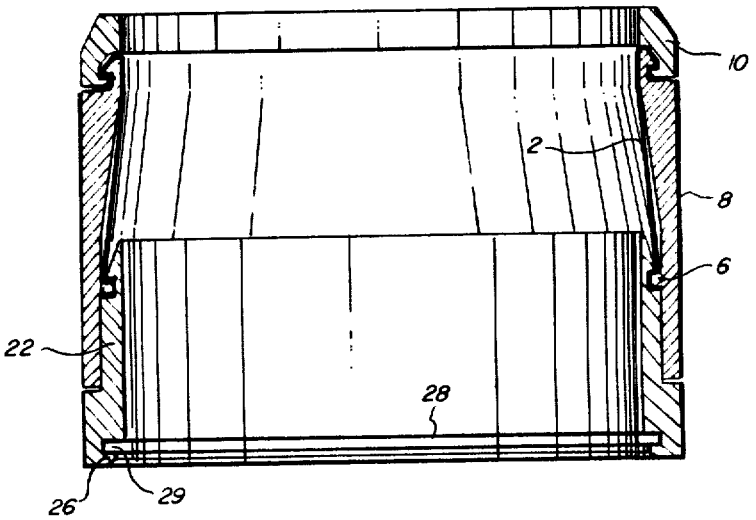
FIG. 4 is a sectional view of still another embodiment of the invention having "snap-action" arms about the container opening for engaging a container.

The embodiment shown in FIG. 4 is identical to the embodiment shown in FIG. 3 except that the body 22 is provided with an inwardly facing, grooved flange 26 (rather than threads) adapted for engagement to a conventional container 28 having a compatable rim 29 of the "snap-action" type.

Figure 5:
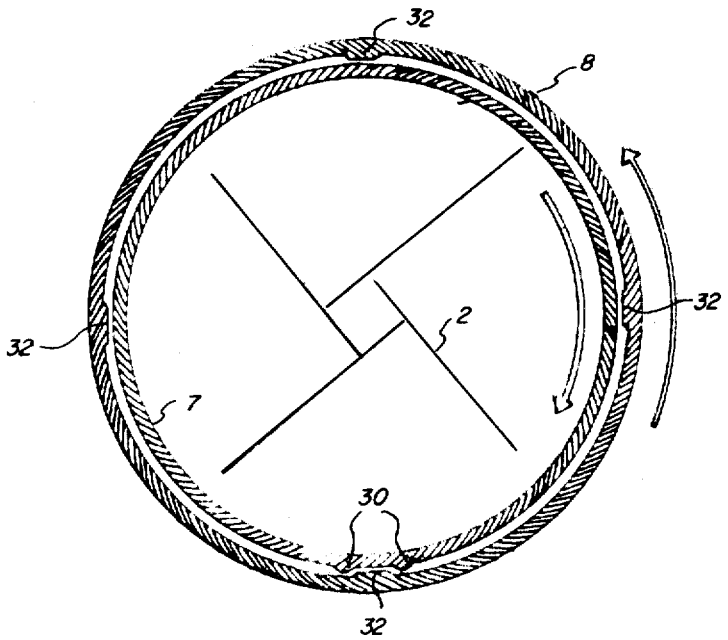
FIG. 5 is a plan view of the discharge area of still another embodiment of the invention having means to restrict the conterrotational movement of the two closure members.

FIG. 5 shows an embodiment of the invention in which the rotatable coacting movement between the container 7 and the body 8 may be restricted so as to (a) permit selectable adjustment of various discharge aperture sizes and (b) restrain the membrane 2 in its fully closed position. A pair of lobes 30 is disposed about the exterior periphery of the container 7 which is adapted to be engaged by a plurality of lobes 32 radially dispersed about the interior surface of the body 8. When the lobes 30 contact one of the lobes 32, rotary action between the container 7 and the body 8 ceases. In order to continue the rotary action, the extra force sufficient to compress the lobes must be applied against either the container 7 or body 8. When the extra force is applied, the lobes 30 and the engaging lobes 32, by virtue of their compression, rounded shape and resiliency (or alternatively by design-permitted distortion of the container 7 or body 8) pass beyond one another in the opposite direction. If desired, indicia may be provided on the surfaces of the container 7 and body 8 to indicate the disposition of the membrane 2.

Figure 6:
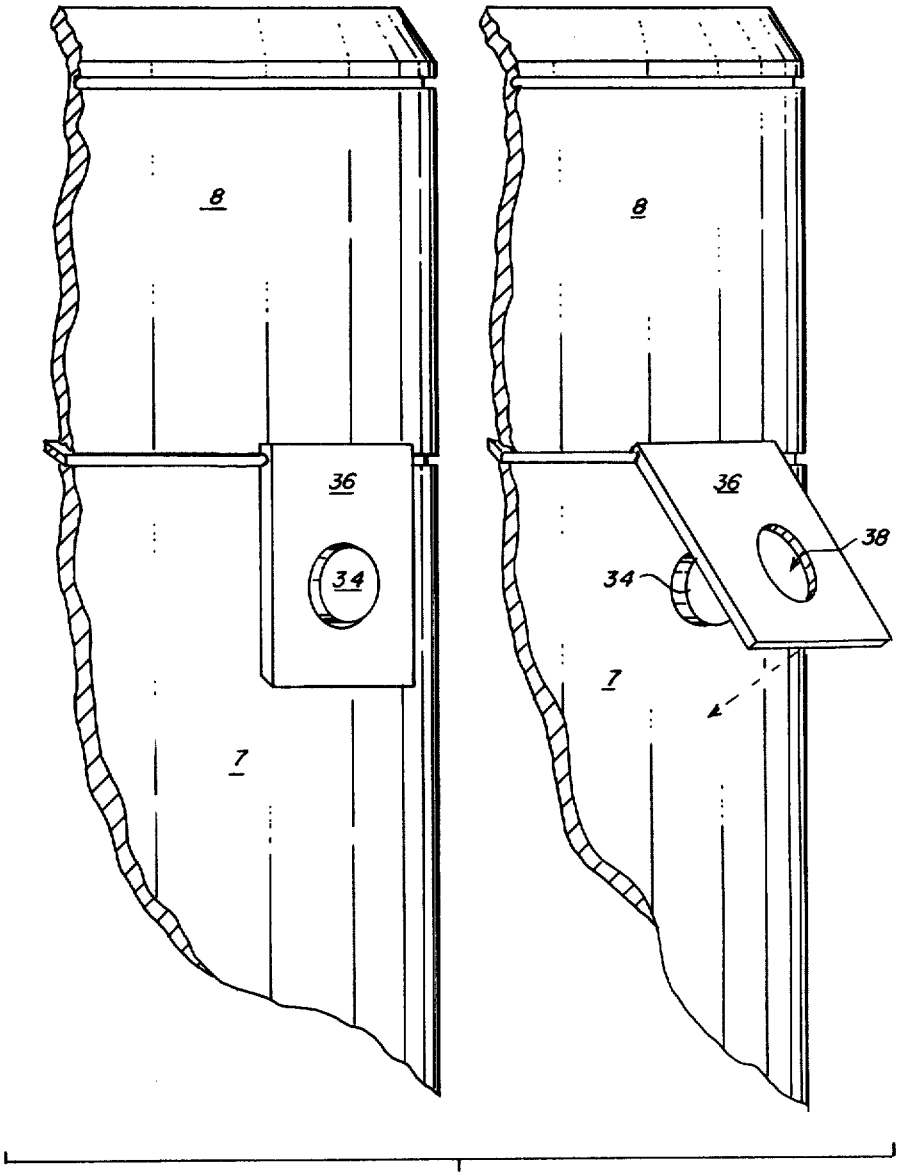
FIG. 6 is a partial perspective view of yet another embodiment of the invention which provides means to lockably secure the closure device at its fully closed position.

FIG. 6 shows an embodiment of the invention in which the container 7 and body 8 may be lockingly engaged so that relative rotation cannot occur until the locking means is disengaged. A receiving post 34 is provided on the container 7 which is diametrically greater at its extreme protruding end than its overall post diameter. A hinged latch 36 is provided in the body 8 having an aperture 38 adapted to become centrally aligned with the post 34 when the body 8 and container 7 are positioned so that the membrane 2 is in its fully closed position. To engage the lock, a downward force is applied to the latch 36 causing the aperture 38 to compressibly pass beyond the extreme protruding end of post 34 and to rest ultimately around the post 34 at a region close to the surface of the container 7. To disengage the lock, an upward prying force is applied against the bottom surface of the latch which again causes the aperture 38 to compressibly pass beyond the extreme protruding end of the post 34.

Figure 7:
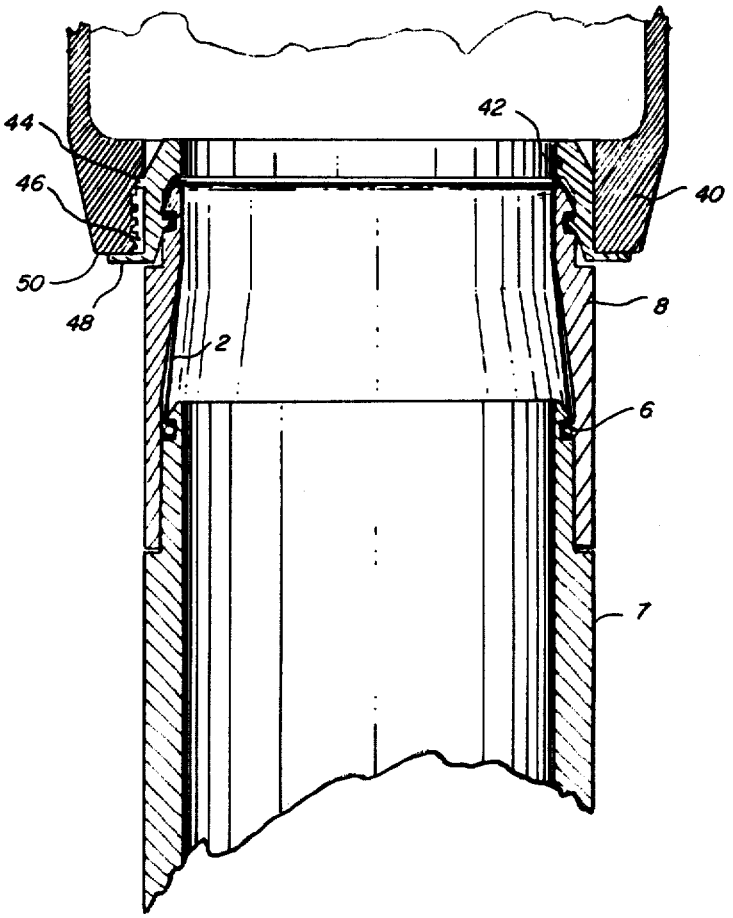
FIG. 7 is a sectional view of yet another embodiment of the invention having means to engagingly coact with a preformed receptacle.

FIG. 7 shows an embodiment of the invention which may coactingly engage with a preformed receiving receptacle 40. In this embodiment, the body clamping device 42 is provided with at least one tab 44 extending from its outer periphery which contacts and engages a corresponding channel(s) 46 when the container 7 is pushed inwardly into the receiving receptacle, with the tab aligned to the channel and then twisted slightly. The clamp device 42 is also provided with a flange 48 which interfaces with a surface 50 of the receptacle 40 so as to provide a positive seal with the receptacle.

Figure 8:
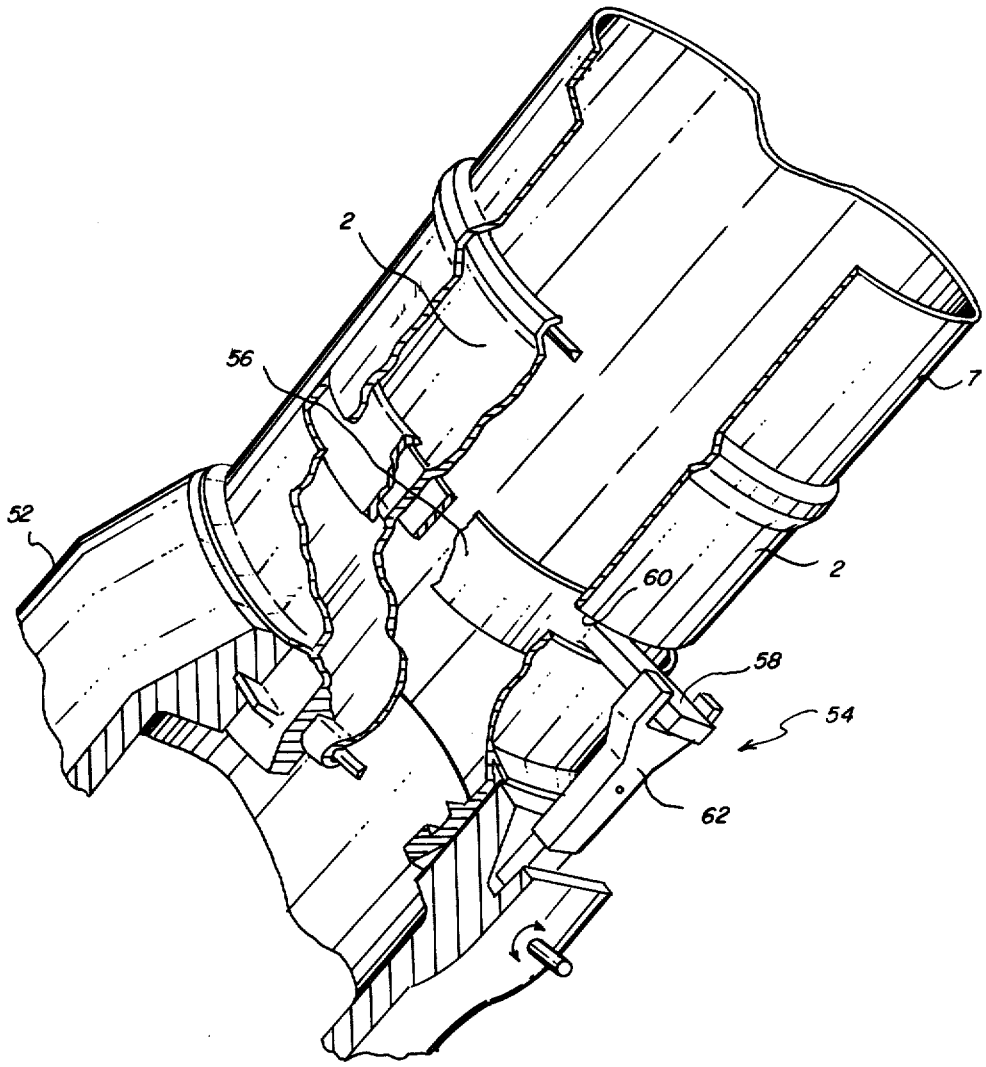
FIG. 8 is a perspective view of still another embodiment of the invention having means to engagingly coact with a preformed receptacle and means disposed within the receptacle to open and close the closure membrane.

FIG. 8 shows an embodiment of invention designed to coact with a preformed receptacle 52 having a mechanism 54 disposed therein for controlling the opening and closing of the membrane 2. The container 7 has an annular member 56 fully contained therein having a lever 58 extending from the container through a slot 60. The lever 58 engages a rotatable, Y shaped lever 62 disposed within the receptacle 52. The lever 62 may be operated by a solenoid, a motor or by any remote controlled mechanism (not shown).

Figure 9:
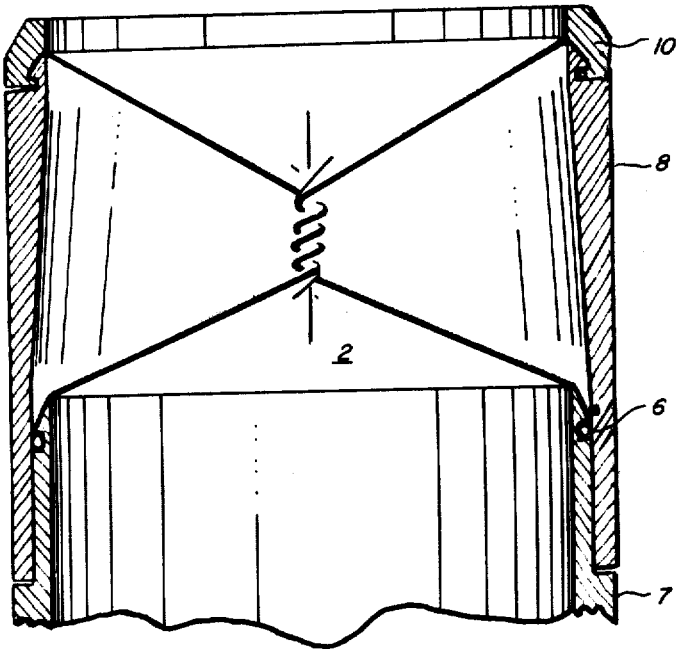
FIG. 9 is a sectional view showing the disposition of the sealing membrane with increased conterrotational movement of the two closure members to achieve a greater sealing surface area.

FIG. 9 shows how the interfacing surface area of the membrane may be increasingly extended so as to provide any desired amount of sealing. While conventional closures have a given sealing surface area and rely on increased sealing surface compression to achieve greater sealing integrity, the present invention requires only that the container 7 and body 8 be further counter-rotated beyond the point where sealing of the closure membrane 2 is first achieved and an increasing surface area of the membrane will continue to come into compressible contact. Where a demanding seal application is required, it is desirable to apply a sealing compound or to weld the interstitial spaces between the membrane 2 and the container 7 and body 8 thereby essentially making the membrane 2 a continuing integral segment of the container 7 and body 8.

Figure 10:
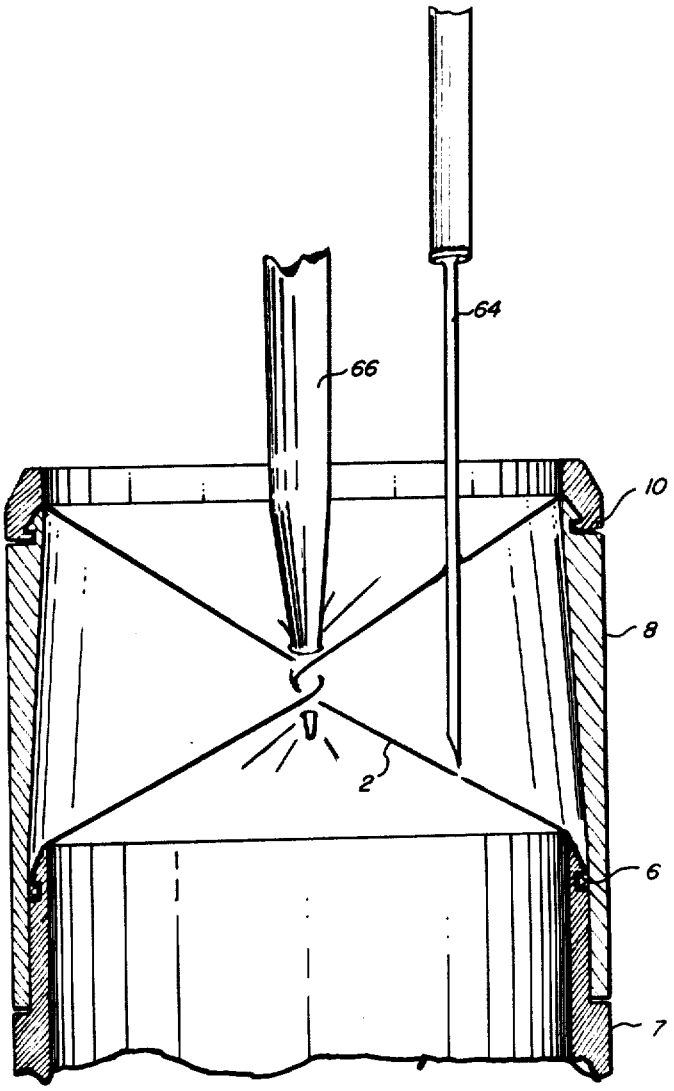
FIG. 10 is a sectional view of still another embodiment of the invention in which the closure is accessed by distending or puncturing the membrane.

FIG. 10 shows how a needle 64 or probe 66 may puncture or distend, respectively, the membrane 2 for the purpose of introducing or extracting contents from the container 7. The resilient properties of the membrane 2 permit it to automatically reseal upon removal of the needle 64 or probe 66.

Figure 11:
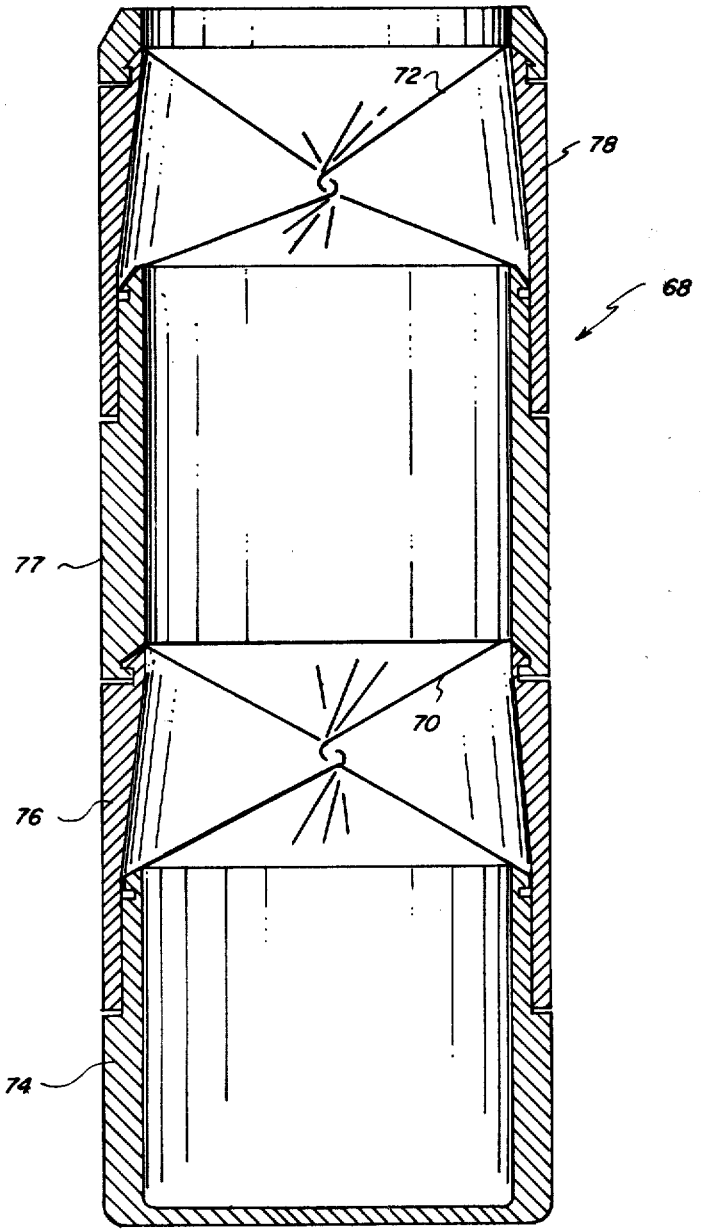
FIG. 11 is a sectional view of yet another embodiment of the invention wherein a plurality of closure devices divide a container into compartments.

FIG. 11 shows an embodiment of the invention wherein a plurality of closure devices conveniently isolate a container 68 into a plurality of compartments. The compartments are isolated by membranes 70 and 72 which function exactly as previously described. The membrane 70 is attached to container members 74 and 76 and the membrane 72 is attached to container member 77 and final closure body 78. In operation container members 74 and 76 may be first rotated to open membrane 70 so as to allow the two compartments defined by members 74 and 77 to open and to admix the previously isolated contents therein without having to remove them from the container 68. Finally, body 78 may be rotated so as to allow access to the contents contained therein. It is also possible to first rotate body 78 so as to allow removal of the contents from the first compartment without disturbing the contents of the second compartment and subsequently rotating members 74 and 76 so as to remove the contents from the second compartment. Any desired number of compartments could be provided in a container by providing the appropriate number of closure devices.

Figure 12:
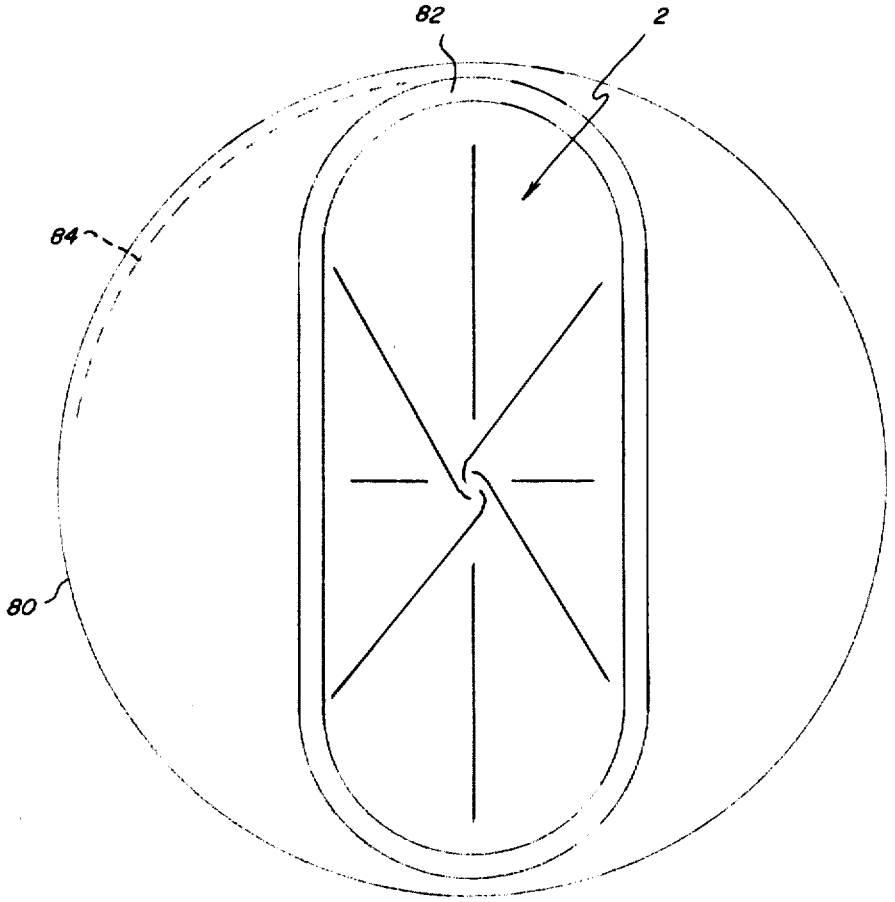
FIG. 12 is a plan view of the discharge area of still another embodiment of the invention which fully conforms to the irregular geometric shape of the container.

FIG. 12 shows an embodiment of the invention designed for use with a container having a discharge area of irregular geometric shape. Membrane 2 is affixed in the usual fashion by means of clamping devices (not shown) and functions in the usual manner except that in order to permit the co-rotating bodies 80 and 82 to function properly, it is necessary to modify a region of such bodies (or alternatively of the clamping devices) to extend about the outside of the closure area by providing a circular flange to flange rotating area 84. The interfacing surfaces of the flanged area may be provided with engaging teeth or lobes so as to provide controllable rotary movement between the bodies 80 and 82.

The invention has been described in detail with references to preferred embodiments thereof, but it will be understood that variations and modifications can be effected within the spirit and scope of the invention. For example, the closure membrane may be clamped either on the interior or exterior surfaces of the coacting counterrotational bodies. A variety of means may be provided to restrictively control the conterrotational movement of the coacting bodies and such means may be disposed in a variety of different locations about the bodies.

I claim:

1. Container closure apparatus comprising:
(a) a first closure body providing a discharge aperture of predetermined size;
(b) a second coacting closure body coaxially disposed about the outside periphery of the first closure body and adapted for relative bi-directional rotation with respect to the first closure body; and
(c) a cylindrically shaped, resilient, distortable membrane having a first terminal end fully affixed to the periphery of the first closure body and a second terminal end fully affixed to the second closure body.

2. The apparatus according to claim 1 wherein said membrane is an elastomer.

3. The apparatus according to claim 1 further comprising clamping means for compressibly sealing the first terminal membrane end to the periphery of the first closure body and the second terminal membrane end to the second closure body.

4. The apparatus according to claim 1 wherein the membrane has a thickness of from approximately 0.009 inches to approximately 0.065 inches.

5. The closure apparatus according to claim 1 wherein said first closure body has a pair of compressible abutments disposed about its exterior periphery and the second closure body has at least one compressible abutment disposed about its interior periphery so that when the abutment of the second closure body contacts the abutments of the first closure body, rotary movement between the first and second closure bodies ceases until extra force sufficient to compress the abutments is applied to either of the closure bodies.

6. The closure apparatus according to claim 1 further comprising a locking post disposed at the exterior periphery of the first closure body and a cooperating locking latch disposed on the exterior periphery of the second closure body, the post and latch being adapted to become lockably engaged upon application thereto of a compressive force and to become disengaged upon the application thereto of a prying force.

7. The apparatus according to claim 1 wherein the first and second closure bodies are formed of materials relatively rigid with respect to the membrane.

8. The apparatus according to claim 1 wherein said first closure body has means for temporarily attaching the first closure body to a container.

* * * * *